US005447202A

United States Patent [19]

Littleford

[11] Patent Number: 5,447,202

[45] Date of Patent: Sep. 5, 1995

[54] SETTING TOOL AND RELATED METHOD

[75] Inventor: Sydney J. Littleford, Montrose, United Kingdom

[73] Assignee: Petroleum Engineering Services, Ltd., Dyce, United Kingdom

[21] Appl. No.: 128,578

[22] Filed: Sep. 30, 1993

[30] Foreign Application Priority Data

Oct. 1, 1992 [GB] United Kingdom ..... 9220707

[51] Int. Cl.[6] ..... E21B 23/00

[52] U.S. Cl. ..... 166/381

[58] Field of Search ..... 166/381–383, 166/385, 206–208, 212, 123

[56] References Cited

U.S. PATENT DOCUMENTS

| | | | |
|---|---|---|---|
| 3,960,215 | 6/1976 | Mitchell . | |
| 4,295,528 | 10/1981 | Carmody | 166/381 |
| 4,429,741 | 2/1984 | Hyland . | |
| 4,535,842 | 8/1985 | Ross . | |
| 4,572,288 | 2/1986 | Kinley . | |
| 4,603,743 | 8/1986 | Lindsey, Jr. | 166/212 X |
| 5,024,277 | 6/1991 | Ricles . | |
| 5,133,412 | 7/1992 | Coronado | 166/381 |
| 5,146,983 | 9/1992 | Hromas et al. . | |

FOREIGN PATENT DOCUMENTS

| | | |
|---|---|---|
| 0467573A2 | 1/1992 | European Pat. Off. . |
| 0500341A1 | 8/1992 | European Pat. Off. . |
| 2486143 | 1/1982 | France . |

*Primary Examiner*—Michael Powell Buiz

*Attorney, Agent, or Firm*—Popham, Haik, Schnobrich & Kaufman, Ltd.

[57] ABSTRACT

A setting tool for setting of any of a variety of down-hole devices used in petroleum/gas producing wells. A known setting tool employs an explosive charge. A disadvantage of this tool is that due to safety considerations, when such tools are in use, radio silence must be maintained on the drilling rig. Another known setting tool employs hydraulic forces. A number of problems exist with known tools. The present a setting tool (5*a*, 5*b*) includes a timer (35*a*, 35*b*), a motor and piston arrangement responsive to the timer, and pressure actuated pistons responsive to the action of the motor and piston arrangement for setting a down-hole device in place at a desired location within a well-bore wherein, in use, the timer is set to a predetermined period of time, the tool in association with the device is conveniently inserted into the well-bore to the desired location, and after the predetermined period has elapsed the timer causes the motor and piston arrangement to actuate so causing the pressure actuated pistons to set the device in place in the well-bore.

9 Claims, 2 Drawing Sheets

SETTING TOOL AND RELATED METHOD

Figure 1:
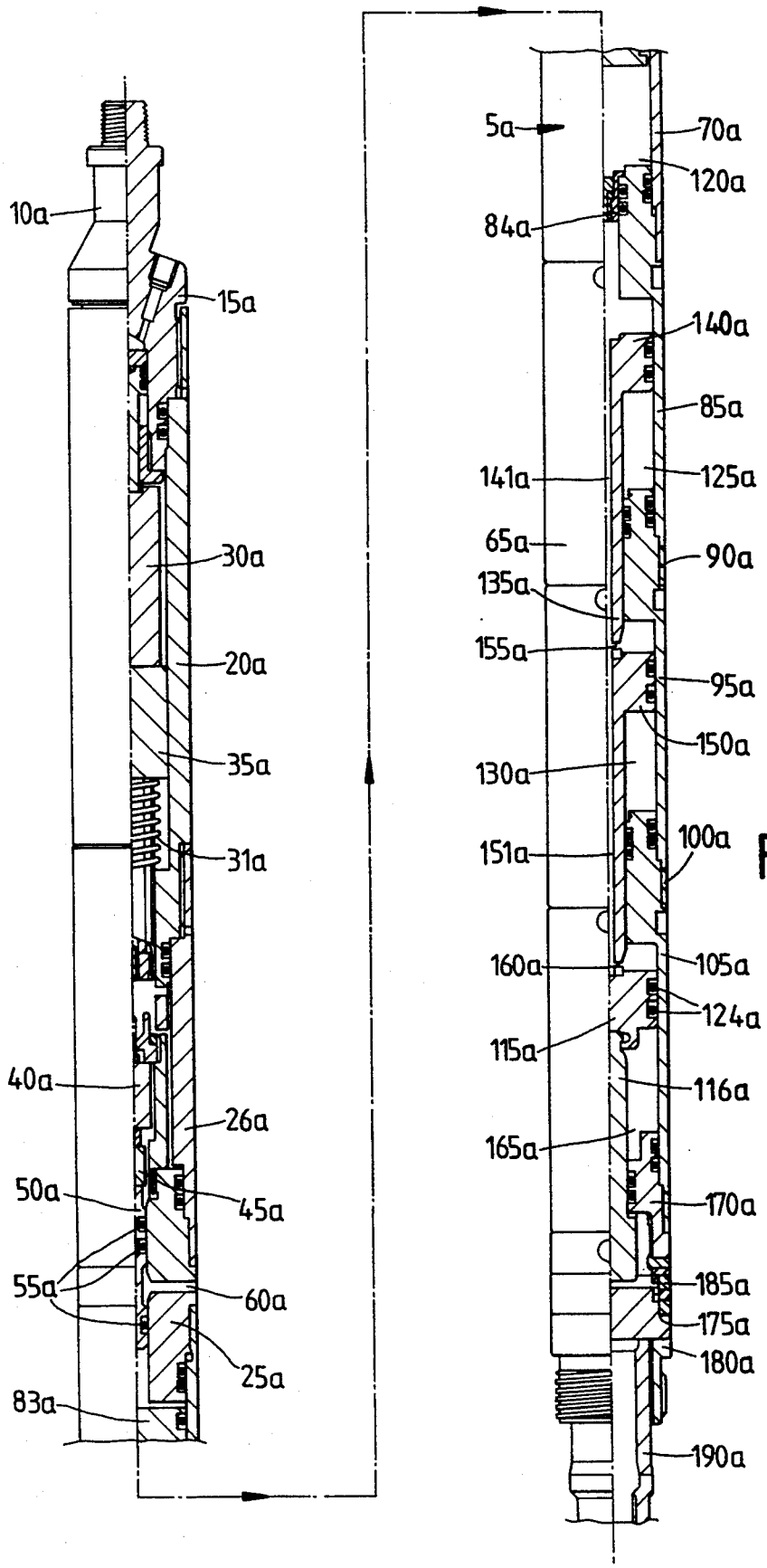

This invention relates to a setting tool for use in the setting of any of a variety of down-hole devices such as though not exclusively, bridge, plugs, cement retainers and permanent packers used in petroleum/gas producing wells.

One type of known setting tool employs an explosive (power) charge. In use, the tool is primed with a charge and lowered down the well-bore to a desired location by wireline. An electrical signal controlled by an above surface rheostat is then sent down the wireline in order to detonate the explosive charge so actuating the tool and setting the device.

A major disadvantage of this type of setting tool is that due to safety considerations, when such tools are in use, radio silence must be maintained on the drilling rig. This is because the detonators used in such are classed as electro-explosive devices requiring special precautions to be taken whilst being handled. These precautions involve the elimination of stray electric potential differences whilst the tool is being assembled at surface. Such potential differences can originate from sources such as radio frequency radiation, electric welding, or lighting storms.

Another type of known setting tool employs hydraulic forces. In use, the tool and device are run down the well-bore on drill-pipe to a desired location. Hydraulic forces are then exerted within the drill-pipe via a hydraulic fluid by a pump or pumps located at the surface. The hydraulic forces thereby actuate the setting tool so setting the device.

A number of problems exist with this type of setting tool. For example, since the tool is run-in on drill-pipe the task is time consuming and expensive - the task typically might take one and a half days to complete. Further, the use of drill-pipe makes it difficult to accurately locate the tool in the bore-hole.

It is, therefore, an object of the present invention to obviate or mitigate the aforementioned disadvantage in the prior art.

According to a first aspect of the present invention there is provided a setting tool comprising a timer, control means responsive to the timer, and setting means responsive to the action of the control means for setting a down-hole device in place at a desired location within a well-bore wherein, in use, the timer is set to a predetermined period of time, the tool in association with the device is conveniently inserted into the well-bore to the desired location, and after the predetermined period has elapsed the timer causes the control means to actuate so causing the setting means to set the device in place in the well-bore.

Preferably, the timer is electronic, the tool providing an electrical power source which supplies electrical power to the timer. The timer is, therefore, not affected by radio frequencies or high voltage interference.

In a first embodiment of the present invention hydrostatic pressure within the well-bore at the desired location is employed to set the device.

In a second embodiment a pyrotechnic charge is employed to set the device.

In the first embodiment, the control means may, therefore, comprise an electric motor responsive to the timer and an actuator responsive to the motor, the electrical power source also supplying electrical power to the electric motor.

Further, the response of the actuator may cause one or more ports communicating through a side wall of the tool to open thereby allowing hydrostatic pressure to be applied to the setting means contained substantially within the tool.

The setting means may comprise a sealed chamber filled with a low viscosity fluid and provide a floating piston a first surface of which is acted upon at the start of a setting sequence by the hydrostatic pressure, in use and a second surface of which forms a first end of the sealed chamber, a second end of the chamber being formed by a first surface of another piston, further comprising one or more hydrostatic chambers the volume of which is reduced by movement of the floating piston due to the action of the hydrostatic pressure, in use.

Speed of setting is controlled by means of a choke which is situated between the second surface of the floating piston and the first surface of another piston in the upper of the hydrostatic chambers. Selection of the number of hydrostatic chamber(s) can, therefore, by used to control the minimum hydrostatic pressure required activate the setting means.

In the second embodiment the control means comprise a timer and an explosive charge comprising a detonator and pyrotechnic charge assembly responsive the actuator such that, in use, when the igniter responds to the timer the explosive charge is detonated so causing the setting means to set the device in place in the well-bore.

The tool and device may be conveniently lowered into the well-bore to a required location by means of wireline.

The wireline may be approximately 0.1875" to 0.092" in diameter.

According to a second aspect of the present invention there is provided a down-hole device integrally incorporating a setting device according to the first aspect of the invention.

According to a third aspect of the present invention there is provided a method of setting a down-hole device in place at a desired location within a well-bore comprising conveniently inserting the device into the well-bore in association with a setting tool to the desired location, the setting tool comprising a timer, control means responsive to the timer, and setting means responsive to the action of the control means, the timer having been set to a predetermined period of time after which predetermined period having elapsed the timer causes the control means to act so causing the setting means to set the device in place in the well-bore.

According to a fourth aspect of the present invention there is provided a retrievable setting tool comprising control means and setting means responsive to the action of the control means for setting a down-hole device in place at a desired location within a well-bore wherein hydrostatic pressure within the well-bore at the desired location is employed to set the device and wherein further, in use, the tool in association with the device is conveniently inserted into the well-bore to the desired location and the control means actuated so causing the setting means to set the device in place in the well-bore by means of the hydrostatic pressure.

The tool may further comprise a timer, and an electrical power source, the control means comprising an electric motor responsive to the timer and an actuator responsive to the electric motor, the electrical power source supplying electric power to the timer and electric motor.

Further, the response of the actuator may cause one or more ports communicating through a side wall of the tool to open thereby allowing hydrostatic pressure to be applied to the setting means contained substantially within the tool.

The setting means may comprise a sealed chamber filled with a low viscosity fluid and provide a floating piston a first surface of which is acted upon at the start of the setting sequence by the hydrostatic pressure, in use, and a second surface of which forms a first end of the sealed chamber, a second end of the chamber being formed by a first surface of another piston, further comprising one or more hydrostatic chambers the volume of which is reduced by movement of the floating piston due to the action of the hydrostatic pressure, in use.

Selection of the number of hydrostatic chamber(s) can, therefore, by used to control the minimum hydrostatic pressure required to activate the setting means.

The tool and device may be conveniently lowered into the well-bore to a required location by means of wireline.

The wireline may be approximately 0.1875" to 0.092" in diameter.

According to a fifth aspect of the present invention there is provided a method of setting a doll-hole device in place at a desired location within a well-bore comprising conveniently inserting the device into the well-bore in association with a setting tool to the desired location, the setting tool comprising control means and setting means responsive to the action of the control means, wherein further actuation of the control means causes the setting means no set the device in place in the well-bore, hydrostatic pressure within the well-bore at the desired location being employed to set the device.

Figure 2:
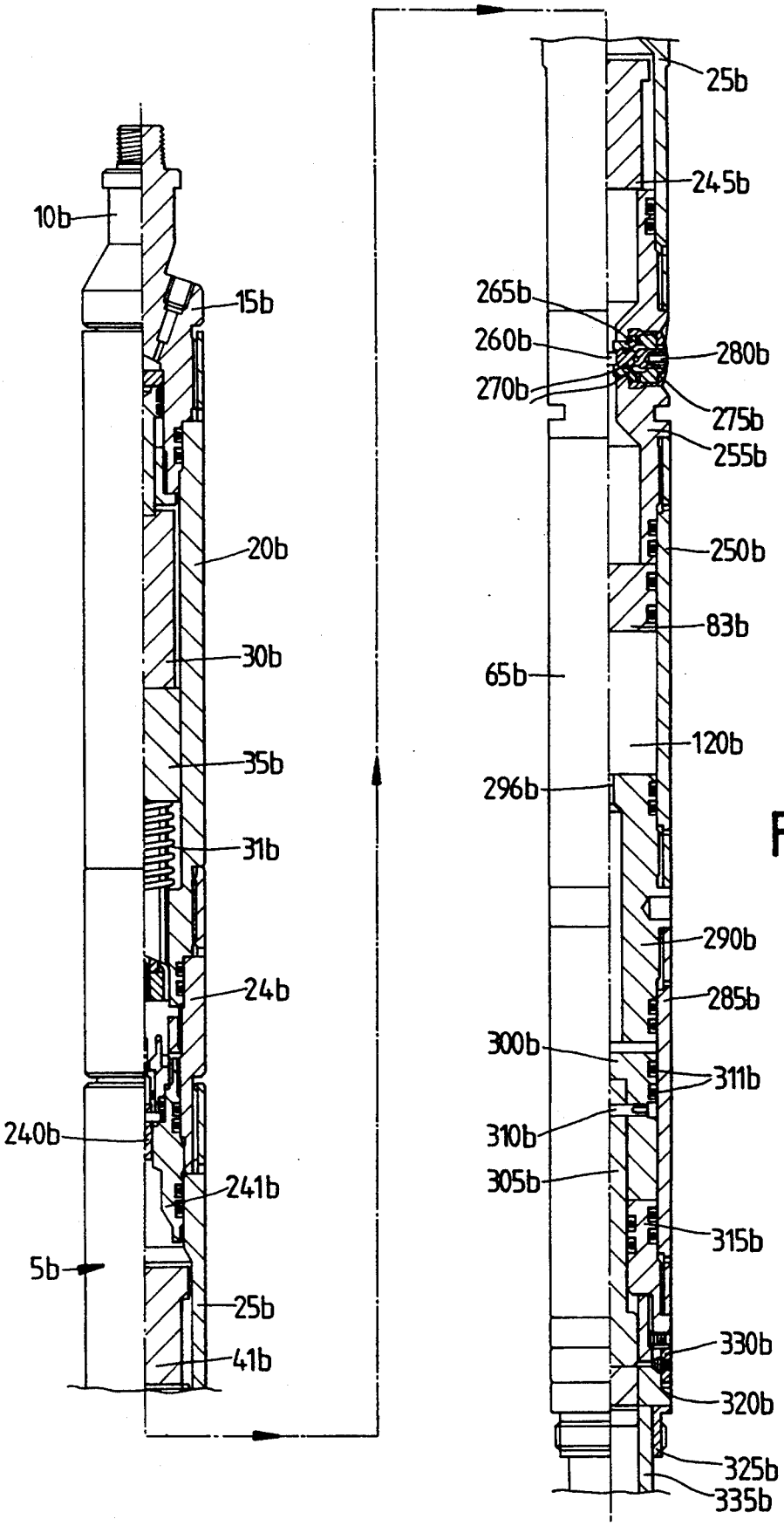

Two embodiments of the present invention will now be described, by way of example only, with reference to the accompanying drawings, which are:

FIG. 1 - a partial cross-sectional side view of a first embodiment of a setting tool according to the present invention in a running-in position; and FIG. 2 - a partial cross-sectional side view of a second embodiment of a setting tool according to the present invention in a running-in position.

Referring to FIG. 1, there is illustrated a first embodiment of a retrievable setting tool, generally designated 5*a*. At a first end 10*a* of the tool 5*a*, which end comprises the uppermost end, in use, there is provided a fishing neck 15*a* (which carries a pressure port and actuating piston) a lower end of which is connected to an upper end of a first housing 20*a*. The lower end of the first housing 20*a* is connected to a second housing 26*a*.

Within the first housing 20*a* there is located a battery pack 30*a*, which preferably supplies a 12–15v DC voltage, and an electronic timer 352 which is supplied with electrical power from the battery pack 30*a* and a retracting spring 31*a*.

An output of the timer 35*a* is further connected to an input of an electric motor 40*a* which is located within the second housing 26*a*.

A mechanical output shaft or lead screw 452 of the motor 40*a* is connected to a first piston 50*a* which is movable by means of the motor 40*a* between a first lower and a second upper position. An outer surface of the first piston 50*a* is sealably and movably engaged with the inner surface of the second housing 26*a* by means of first and second seals 552. As can be seen from FIGS. 1 and 2 a plurality of first ports 60*a* extend through the side wall of the housing 26*a*. When the piston 50*a* is in the lower position the ports 60*a* are effectively closed, while when the piston 50*a* is in the upper position the ports 60*a* are effectively open, opening a path(s) from outside the tool 5*a* to inside a lower end of the second housing 26*a*.

The lower end of the second housing 26*a* is sealably connected to an upper end of a setting means, generally designated 65*a*. The setting means 65*a* comprises a cylindrical 70*a*, within which there is provided a second, floating piston 83*a*.

Connected to a lower-facing innermost surface of the cylinder 70*a* is a first cylindrical outer shell portion 85*a* which is connected to a second cylindrical outer shell portion 95*a* which is similarly connected via a second connector sub 100*a* to a lower cylinder 105*a*. Contained in the upper surface of 85*a* is a so-called controlled orifice bean 84*a*.

Also provided within the lower cylinder 105*a* is a third piston 115*a*, an outermost edge of which has a seal 124*a* allowing sealed movement of the edge along an innermost edge of the cylinder 105*a*.

It can, therefore, be seen that the second, floating piston 83*a* and the third piston 115*a* comprise the upper and lower limits of a sealed chamber 120*a* which is filled with a low viscosity fluid.

Provided within the sealed chamber 120*a* are first, second and subsequent sealed hydrostatic chambers 125*a*, 130*a* etc. The chamber 125*a* is defined by a portion of an innermost surface of the first cylindrical outer shell portion 85*a*, an innermost surface of the first connector sub 90*a*, an outerfacing surface of a first mandrel 135*a* and an outwardly/downwardly facing surface of a fourth piston 140*a*. The fourth piston is moveable downwardly within the sealed chamber 120*a* - so as to reduce the volume of the first hydrostatic chamber 125*a* - in response to hydrostatic pressure acting on the second piston 83*a*. The extend of movement is limited when an upperfacing surface of the first sub connector 90*a* abuts a lowerfacing surface of the fourth piston 140*a*.

Likewise the second hydrostatic chamber 130*a* is defined by a portion of an innermost surface of the second cylindrical outer shell portion 95*a*, an innermost surface of the third cylinder 105*a* (or subsequent cylinder identical to 95*a*), an outerfacing surface of fifth piston rod 150*a* and an outwardly/downwardly facing surface of a fifth piston 150*a*. An upperfacing surface of the fifth piston 150*a* further abuts a lowerfacing surface of a lowermost end of the first mandrel 135*a*. Also, an upperfacing surface of the third piston 115*a* abuts a lowerfacing surface of the fifth piston rod 150*a* (or subsequent piston rods identical to 150*a*).

Pistons 140*a*, 150*a* and any subsequent pistons have a drilled longitudinal passage from the upper surface of the piston, to the lower end of its respective piston rod. These passages are designated 141*a* and 151*a* respectively.

The fourth and fifth (and subsequent) piston rods 140*a* and 150*a* have first, second and subsequent ports 155*a* and 160*a* extending radially therethrough at or near the lower ends thereof.

As can be seen from FIG. 1, the third piston 115*a* with its piston rod 116*a* is T-shape in cross-section, and a third hydrostatic chamber 165*a* is defined by the inside of the T-shape, an inner portion of the lower cylinder 105*a* and an upperfacing surface of a cylinder head 170*a* which closes the lower cylinder 105*a*.

The third piston rod 116*a* extends through a central aperture in the cylinder head 170*a*, a cross-link 175*a* being provided near to a lowermost end of the third piston 115*a*. An outer edge of the cross-link 175*a* engages a cross link sleeve 180*a*. These are held together by a link retaining ring 185*a*. The cross-link sleeve 180*a* rides over the setting mandrel 190*a*.

In use, the timer 35*a* is set to a predetermined period, for example, 2 hours. The tool 5*a* is then lowered down a bore-hole by slack-line or piano wire - attached to a sucker rod connection at the first upper end 10*a* of the fishing neck 15*a* to the required depth. A device (not shown) is retained on the lower end of the tool 5*a* by means of a shear ring (not shown) as is known in the art, the setting mandrel 190*a* extending within the device.

After the predetermined period has elapsed, the timer 35*a* activates the motor 40*a*, the lead screw of which retracts the first piston 50*a* to its second position thereby opening the ports 60*a*. Hydrostatic pressure is therefore applied to the second piston 83*a* causing downward movement of the fourth and fifth and subsequent pistons 140*a*, 150*a* etc and consequential downward movement of the third piston 115*a*, cross-link 175*a* and cross-link sleeve 180*a*, thereby setting the device by the downward movement of the link sleeve 180*a*. The shear ring shears allowing the retrieval of the tool 5*a*.

Referring to FIGS. 2, there is illustrated a second embodiment of a retrievable setting tool, generally designated 5*b*. At a first end 10*b* of the tool 5*b*, which end comprises the uppermost end, in use, there is provided a fishing neck 15*b* (which carries a pressure port and actuating piston) the lower end of which is connected to a first housing 20*b* which is connected via a connector sub 24*b* to a second housing 25*b*.

Within the first housing 20*b* there is located a battery pack 30*b*, which preferably supplies a 12—15v DC voltage, and an electronic timer 35*b* which is supplied with electrical power from the battery pack 30*b*, and retracting spring 31*b*. An output of the timer 35*b* is further connected upon application of hydrostatic pressure to an input of a detonator 240*b* which is located within a detonator housing 241*b* in an upper end of the second housing 25*b*.

Within the second housing 25*b* there is provided a pyrotechnic charge 245*b*. Also, a lower end of the second housing 25*b* is connected to an upper cylinder 250*b* via a gas vent sub 255*b* providing a gas vent aperture 260*b*, gas vent seat 265*b*, o-rings 270*b*, gas vent retrainer 275*b*, and gas vent plug 280*b*, as is known in the art.

The upper end of the upper cylinder 250*b* comprises the upper end of a setting means, generally designated 65*b*. The setting means 65*b* comprises the upper cylinder 250*b* having a floating piston 83*b* located at or near the upper end thereof. The upper cylinder 250*b* is sealably connected to a lower cylinder 285*b* via a cylinder connector 290*b* having an aperture 296*b* extending between inner volumes of each of the cylinders 250*b*, 285*b*.

At or near an upper end of the lower cylinder 285*b* is provided a piston 300*b* which is connected to a piston rod 305*b* by means of a pin retaining screw 310*b*. The piston 300*b* is sealably moveable along an innerfacing surface of the lower cylinder 285*b* by means of o-rings 311*b* on an outer surface of the piston 300*b*. Further, the piston rod 305*b* extends substantially through the lower cylinder 285*b*, substantially coaxially therewith.

The pistons 83*b*, 300*b* therefore comprise the upper and lower limits of a sealed chamber, generally designated 120*b*, which is filled with a low viscosity fluid.

A cylinder head 315*b* which is of T-shaped cross-section closes a lower end of the lower cylinder 285*b*, the piston rod 305*b* extending through an aperture in the cylinder head 315*b*. At or near the lower end of the piston rod 305*b* is a cross-link 320*b* which is connected to a cross-link sleeve 325*b* via a link retaining ring 330*b*. Further, within the cross-link sleeve 325*b* there is provided a second mandrel 335*b*.

In use, the timer 35*b* is set to a predetermined period - for example 2 hours. The tool 5*b* is then lowered down a bore-hole by slick-line or piano wire - attached to a sucker rod connector at the first upper end 10*b* of the fishing neck 15*b* - to the required depth. A device (not shown) is retained on the lowermost end of the tool 5*b* by means of a shear ring (not shown), as is known in the art, the second mandrel 335*b* extending within the device.

After the predetermined period has elapsed the timer 35*b* fires the detonator 240*b* which fires (ignites) the pyrotechnic charge 245*b* thereby causing downward movement of the first piston 83*b*, consequential downward movement of the second piston and piston rod 305*b* and thereby also consequential downward movement of the cross-link sleeve 335*b*, thereby setting the device.

The shear ring shears allowing retrieval of the device 5*b* and the gas vent screw 275*b* allows residual gases created by the ignition of the pyrotechnic charge 245*b* to be bled from within the first and second housing 245*b* and 25*b* and gas vent sub 225*b*.

The embodiments of the present invention hereinbefore described are given by way of example only and are not meant to limit the scope of the invention in any way.

I claim:

1. A setting tool for placing a down-hole device in a desired position in a well-bore comprising:

an elongated housing;

a timer mounted near a first end of the housing;

control means connected to the timer and being responsive to the timer, with the control means comprising an electric motor mounted within the housing and being activated by the timer and an actuator connected to and driven by the electric motor; and setting means guided within said housing and being pressure actuated as a result of movement of said actuator, wherein, in use, the timer is set to a predetermined period of time, the setting tool in association with the down-hole device is inserted into the well-bore to the desired location, and after the predetermined time has elapsed the timer causes the control means to actuate, so causing the setting means to set the device in place in the well-bore.

2. A setting tool as claimed in claim 1, wherein the timer is electronic and the setting tool further includes an electrical power source mounted within said housing for providing electrical power to said timer.

3. A setting tool as claimed in claim 2, wherein the electrical power source also supplies power to said electric motor.

4. A setting tool as claimed in claim 3, wherein movement of said actuator causes one or more ports communicating through said housing of said setting tool to open, thereby allowing hydrostatic pressure from said well bore to be applied to said setting means.

5. A setting tool as claimed in claim 4, wherein said setting means comprises a sealed chamber filled with a low viscosity fluid and a floating piston having a first surface that is acted upon by the hydostatic pressure, and a second surface that forms a first end of the sealed chamber, with a second end of the sealed chamber being formed by a first surface of a second piston.

6. A setting tool as claimed in claim 5, wherein the setting means further comprises one or more hydrostatic chambers the volume of which is reduced by movement of the floating piston due to the action of the hydrostatic pressure.

7. A setting tool as claimed in claim 6, wherein the setting tool further includes means for lowering the tool into the well-bore to a required location.

8. A setting tool as claimed in claim 7, wherein the means for lowering comprises a wireline having a diameter that is preferably in the range of 0.1875 inch to 0.092 inch.

9. A method of setting a down-hole device in place at a desired location within a well-bore comprising the steps of:

setting a timer on a setting tool to a predetermined period of time;

lowering the down-hole device into the well-bore along with the setting tool to the desired location;

activating an electric motor supported within said setting tool after said predetermined period of time has elapsed;

driving an actuating mechanism with said electric motor; and opening communication for hydrostatic pressure within said well-bore to enter said setting tool and act upon setting means contained within said setting tool.

* * * * *

UNITED STATES PATENT AND TRADEMARK OFFICE

CERTIFICATE OF CORRECTION

PATENT NO. : 5,447,202

DATED : September 5, 1995

INVENTOR(S) : Sydney J. Littleford

It is certified that error appears in the above-indentified patent and that said Letters Patent is hereby corrected as shown below:

Column 6, line 42, change "near a first end of" to --within--; and

Column 7, line 6, change "hydostatic" to --hydrostatic--.

Signed and Sealed this

Twenty-seventh Day of February, 1996

*Attest:*

Bruce Lehman

BRUCE LEHMAN

*Attesting Officer*

*Commissioner of Patents and Trademarks*